US008749937B2

(12) United States Patent
Nakamoto et al.

(10) Patent No.: US 8,749,937 B2
(45) Date of Patent: Jun. 10, 2014

(54) DISPLAY DEVICE

(75) Inventors: Toshihiro Nakamoto, Ichinomiya (JP); Satoshi Takahashi, Isumi (JP)

(73) Assignees: Japan Display Inc., Tokyo (JP); Panasonic Liquid Crystal Display Co., Ltd., Hyogo (JP)

( * ) Notice: Subject to any disclaimer, the term of this patent is extended or adjusted under 35 U.S.C. 154(b) by 311 days.

(21) Appl. No.: 13/242,005

(22) Filed: Sep. 23, 2011

(65) Prior Publication Data

US 2012/0075764 A1 Mar. 29, 2012

(30) Foreign Application Priority Data

Sep. 28, 2010 (JP) ..... 2010-216374

(51) Int. Cl.
*H02H 9/08* (2006.01)

(52) U.S. Cl.
USPC ..... 361/93.9

(58) Field of Classification Search
USPC ..... 361/93.9
See application file for complete search history.

(56) References Cited

U.S. PATENT DOCUMENTS

| | | | | |
|---|---|---|---|---|
| 3,845,405 | A * | 10/1974 | Leidich | 330/298 |
| 4,893,158 | A * | 1/1990 | Mihara et al. | 257/341 |
| 5,400,206 | A * | 3/1995 | Barnes et al. | 361/72 |
| 5,859,757 | A * | 1/1999 | Hanafusa et al. | 361/100 |
| 6,452,415 | B1 * | 9/2002 | Farnworth et al. | 361/101 |
| 7,064,945 | B2 * | 6/2006 | Amano et al. | 361/93.1 |
| 7,505,240 | B2 * | 3/2009 | Asada et al. | 361/93.1 |
| 2004/0027753 | A1 * | 2/2004 | Friedrichs et al. | 361/90 |
| 2004/0027759 | A1 * | 2/2004 | Katoh | 361/93.7 |
| 2007/0152942 | A1 | 7/2007 | Yamagishi | |
| 2007/0206338 | A1 * | 9/2007 | Ishino | 361/93.9 |
| 2008/0304197 | A1 * | 12/2008 | Higashi | 361/93.7 |
| 2009/0190280 | A1 * | 7/2009 | Daio et al. | 361/98 |
| 2011/0075307 | A1 * | 3/2011 | Murota | 361/57 |
| 2011/0194217 | A1 * | 8/2011 | Davis et al. | 361/18 |

FOREIGN PATENT DOCUMENTS

| | | |
|---|---|---|
| JP | H05-84140 | 11/1993 |
| JP | 2000-175345 | 6/2000 |
| JP | 2002-101547 | 4/2002 |
| JP | 2007-183329 | 7/2007 |

OTHER PUBLICATIONS

Office Action in corresponding Japanese Application No. 2010-216374, Dated Nov. 7, 2013, with partial English translation thereof.

* cited by examiner

*Primary Examiner* — Ronald W Leja
(74) *Attorney, Agent, or Firm* — Antonelli, Terry, Stout & Kraus, LLP.

(57) ABSTRACT

Provided is a display device which enables the automatic return of a power source circuit after the power source circuit is protected from an overcurrent, at low cost. The display device includes: an output transistor having a base to which a drive voltage signal is inputted and outputting a drive voltage from an emitter; a first transistor being turned on when an overcurrent flows into the output transistor; and a second transistor being turned on and turning off the output transistor when the first transistor is turned on, the first and second transistors are repeatedly turned on and off so as to make the output transistor intermittently operate within an overcurrent operation period, and the first and second transistors are turned off and the output transistor automatically returns to a normal operation when an operation period is shifted from the overcurrent operation period to a normal operation period.

8 Claims, 3 Drawing Sheets

DISPLAY DEVICE

CROSS-REFERENCE TO RELATED APPLICATION

The present application claims priority from Japanese patent application JP 2010-216374 filed on Sep. 28, 2010, the content of which is hereby incorporated by reference into this application.

BACKGROUND OF THE INVENTION

1. Field of the Invention

The present invention relates to a display device, and more particularly to an overcurrent protection circuit of a power source circuit.

2. Description of the Related Art

A TFT type liquid crystal display device which uses thin film transistors as active elements is used as a display device such as a television receiver set, a display of a personal computer or the like since the liquid crystal display device can display a high-definition image.

A liquid crystal display device used in general includes a so-called liquid crystal display panel where a liquid crystal layer is sandwiched between two (a pair of) substrates, wherein at least one of the substrates is made of transparent glass or the like. In operation, by selectively applying a voltage to various electrodes for forming pixels which are formed on the substrate of the liquid crystal display panel, predetermined pixels are turned on or off so that the liquid crystal display device exhibits excellent contrast performance and high-speed display performance.

JP 2007-183329 A (patent document 1) discloses a liquid crystal display device which is constituted of a liquid crystal display panel, a gate driver part, a source driver part, a display control circuit and a power source circuit.

SUMMARY OF THE INVENTION

In the power source circuit of the above-mentioned liquid crystal display device, there is a case where an output is short-circuited from a certain cause so that an overcurrent flows into the power source circuit. In such a case, it is necessary to take measures to prevent a problem on reliability caused by the abnormal generation of heat in the parts. For this end, the power source circuit includes a protection circuit. As an example of the protection circuit, there have been known a circuit which limits a collector current of an output transistor when short-circuiting occurs (hereinafter referred to as a protection circuit of an example 1) and a circuit which cuts off an output by controlling a bias potential of an output transistor when short-circuiting occurs (hereinafter referred to as a protection circuit of an example 2). However, in the case of the protection circuit of the example 1, a limited electric current continues to flow and hence, it is necessary to select parts which are resistant against generated heat thus incurring an extra cost for parts. In the case of the protection circuit of the example 2, the recovery of a system requires an operation to reset the circuit and hence, the circuit is not applicable to the application where automatic recovery of an output is requested after abnormality is eliminated.

The present invention has been made to overcome the above-mentioned drawbacks of the related art, and it is an object of the present invention to provide a display device which enables the automatic return of a power source circuit after the power source circuit is protected from an overcurrent, and can provide a power source circuit protecting function at a low cost thus reducing a manufacturing cost of the display device.

The above-mentioned and other objects of the present invention and novel technical features of the present invention will become apparent by the description of this specification and attached drawings.

To briefly explain the summary of typical inventions among the inventions disclosed in the specification, they are as follows.

(1) According to one aspect of the present invention, there is provided a display device which includes: a display panel (for example, liquid crystal display panel) having a drive circuit; and a power source circuit which supplies a drive voltage to the drive circuit, the power source circuit including: a drive voltage signal generation circuit which generates a drive voltage signal; an output circuit to which the drive voltage signal generated by the drive voltage signal generation circuit is inputted, the output circuit outputting the drive voltage based on the drive voltage signal; and a protection circuit which protects the output circuit when an overcurrent flows into the output circuit, wherein assuming a period during which an overcurrent continuously flows into the output circuit as an overcurrent operation period and a period during which the output circuit is normally operated as a normal operation period, the protection circuit makes the output circuit intermittently operate within the overcurrent operation period, and the protection circuit is turned off and the output circuit automatically returns to a normal operation when an operation period is shifted from the overcurrent operation period to the normal operation period.

(2) According to another aspect of the present invention, there is provided a display device which includes: a display panel (for example, liquid crystal display panel) having a drive circuit; and a power source circuit which supplies a drive voltage to the drive circuit, the power source circuit including: a drive voltage signal generation circuit which generates a drive voltage signal; an output circuit to which the drive voltage signal generated by the drive voltage signal generation circuit is inputted, the output circuit outputting the drive voltage based on the drive voltage signal; and a protection circuit which protects the output circuit when an overcurrent flows into the output circuit, wherein the protection circuit includes: a detection circuit which detects that the overcurrent flows into the output circuit; and a bias circuit which controls the output circuit when the detection circuit detects that the overcurrent flows into the output circuit; and assuming a period during which an overcurrent continuously flows into the output circuit as an overcurrent operation period and a period during which the output circuit is normally operated as a normal operation period, the bias circuit makes the output circuit intermittently operate within the overcurrent operation period, and the bias circuit is turned off and the output circuit automatically returns to a normal operation when an operation period is shifted from the overcurrent operation period to the normal operation period.

(3) According to another aspect of the present invention, there is provided a display device including: a display panel (for example, liquid crystal display panel) having a drive circuit; and a power source circuit which supplies a drive voltage to the drive circuit, the power source circuit including: a drive voltage signal generation circuit which generates a drive voltage signal; an output transistor which has a control electrode to which the drive voltage signal generated by the drive voltage signal generation circuit is inputted, the output transistor outputting the drive voltage from a first electrode; a first transistor which is turned on when an overcurrent flows into the output transistor; and a second transistor which is turned on and turns off the output transistor when the first transistor is turned on, wherein assuming a period during which the overcurrent continuously flows into the output transistor as an overcurrent operation period and a period during which the output transistor is normally operated as a normal operation period, the first transistor and the second transistor are repeatedly turned on and off so as to make the output transistor intermittently operate within the overcurrent operation period, and the first transistor and the second transistor are turned off and the output transistor automatically returns to a normal operation when an operation period is shifted from the overcurrent operation period to the normal operation period.

(4) According to another aspect of the present invention, there is provided a display device including: a display panel (for example, liquid crystal display panel) having a drive circuit; and a power source circuit which supplies a drive voltage to the drive circuit, the power source circuit including: a drive voltage signal generation circuit which generates a drive voltage signal; an output transistor which has a control electrode to which the drive voltage signal generated by the drive voltage signal generation circuit is inputted, the output transistor outputting the drive voltage from a first electrode; a first resistance element which is connected between a second electrode of the output transistor and a first power source line to which a first power source voltage is supplied; a first transistor which has a first electrode thereof connected to the first power source line and a control electrode thereof connected to the second electrode of the output transistor; a second resistance element which is connected between a second electrode of the first transistor and a second power source line to which a second power source voltage is supplied; and a second transistor which has a first electrode thereof connected to the second power source line, a second electrode thereof connected to the control electrode of the output transistor, and a control electrode thereof connected to the second electrode of the first transistor, wherein assuming a period during which the overcurrent continuously flows into the output transistor as an overcurrent operation period and a period during which the output transistor is normally operated as a normal operation period, the first transistor and the second transistor are repeatedly turned on and off so as to make the output transistor intermittently operate within the overcurrent operation period, and the first transistor and the second transistor are turned off and the output transistor automatically returns to a normal operation when an operation period is shifted from the overcurrent operation period to the normal operation period.

(5) In the display device having the above-mentioned constitution (4), the power source circuit further includes a series circuit constituted of a third resistance element and a fourth resistance element between the second resistance element and the second power source line, and the control electrode of the second transistor is connected to a connection point between the third resistance element and the fourth resistance element.

(6) In the display device having the above-mentioned constitution (4) or (5), the output transistor, the first transistor and the second transistor are each formed of a bipolar transistor.

(7) In the display device having the above-mentioned constitution (6), the output transistor and the second transistor are each formed of an npn-type bipolar transistor, and the first transistor is formed of a pnp-type bipolar transistor.

To briefly explain advantageous effects acquired by the typical inventions disclosed in the specification, they are as follows.

According to the present invention, it is possible to provide a display device which enables automatic return of a power source circuit after the power source circuit is protected from an overcurrent, and can provide a power source circuit protecting function at a low cost thus reducing a manufacturing cost of the display device.

DETAILED DESCRIPTION OF THE INVENTION

Hereinafter, an embodiment of the present invention is explained in detail in conjunction with drawings.

Here, in all drawings for explaining the embodiment, parts having identical functions are given same symbols and their repeated explanation is omitted. Further, the embodiment explained hereinafter should not be used for limiting the interpretation of the scope of claims of the present invention.

Embodiment

Figure 1:
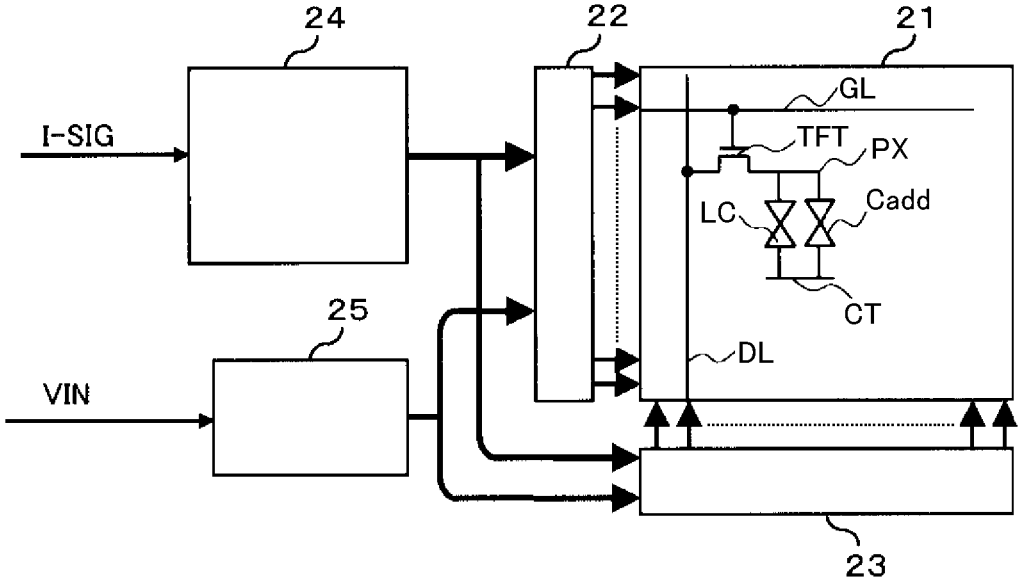
FIG. 1 is a block diagram showing the schematic constitution of a liquid crystal display device according to an embodiment of the present invention.

FIG. 1 is a block diagram showing the schematic constitution of a liquid crystal display device according to an embodiment of the present invention.

The liquid crystal display device of this embodiment is constituted of a liquid crystal display panel 21, a drain driver part 22, a gate driver part 23, a display control circuit 24 and a power source circuit 25.

The drain driver part 22 is constituted of a plurality of drain drivers, and the plurality of drain drivers are mounted on a peripheral portion of the liquid crystal display panel 21. For example, the plurality of drain drivers are mounted on the peripheral portion of one side of a first substrate (for example, glass substrate) out of a pair of substrates of the liquid crystal display panel 21 by a COG (Chip On Glass) method. Alternatively, the plurality of drain drivers are mounted on a flexible printed circuit board which is arranged on a peripheral portion of a side of the first substrate of the liquid crystal display panel 21 by a COF (Chip On Film) method.

In the same manner as the drain driver part 22, the gate driver part 23 is constituted of a plurality of gate drivers, and the plurality of gate drivers are mounted on a peripheral portion of the liquid crystal display panel 21. For example, the plurality of gate drivers are mounted on a peripheral portion of one side (one side other than the side on which the drain drivers are mounted) of the first substrate (for example, glass substrate) out of the pair of substrates of the liquid crystal display panel 21 by a COG method. Alternatively, the plurality of gate drivers are mounted on a flexible printed circuit board which is arranged on a peripheral portion of one side (one side other than the side on which the drain drivers are mounted) of the first substrate of the liquid crystal display panel 21 by a COF method.

Further, the display control circuit 24 and the power source circuit 25 are respectively mounted on a printed circuit board which is arranged on a peripheral portion (for example, a back side surface of the liquid crystal display device) of the liquid crystal display panel 21.

The display control circuit 24 converts a display signal inputted from a display signal source such as a personal computer or a television receiving circuit into display data in display format by performing timing adjustment appropriate to display by the liquid crystal display panel 21 (for example, the conversion of a voltage corresponding to a display signal into a voltage having an AC waveform), and inputs the display data to respective drain drivers of the drain driver part 22 and respective gate drivers of the gate driver part 23 together with a synchronizing signal (clock signal).

By a control of the display control circuit 24, the respective gate drivers sequentially supply a selection scanning voltage to corresponding scanning lines (also referred to as gate lines; GL), and the respective drain drivers supply a video voltage to corresponding video lines (also referred to as drain lines or source lines; DL) so that an image is displayed. The power source circuit 25 generates various voltages necessary for the liquid crystal display device.

The liquid crystal display panel 21 includes a plurality of sub pixels, and each of the plurality of sub pixels is arranged in an area surrounded by the corresponding video lines (DL) and the corresponding scanning lines (GL).

Each of the plurality of sub pixels includes a thin film transistor (TFT). In the thin film transistor (TFT), a first electrode (either one of a drain electrode and a source electrode) of the thin film transistor (TFT) is connected to the corresponding video line (DL), and a second electrode (the other of the source electrode and the drain electrode) of the thin film transistor (TFT) is connected to a pixel electrode (PX). Further, a gate electrode of the thin film transistor (TFT) is connected to the corresponding scanning line (GL).

In FIG. 1, symbol LC indicates a liquid crystal capacity equivalently indicative of a liquid crystal layer arranged between the pixel electrode (PX) and a counter electrode (CT), and symbol Cadd indicates a holding capacity formed between the pixel electrode (PX) and the counter electrode (CT). Although only one sub pixel is shown in FIG. 1, in an actual liquid crystal display device, the plurality of sub pixels are arranged in a matrix array on the liquid crystal display panel 21.

In the liquid crystal display panel 21 shown in FIG. 1, the first electrodes of the thin film transistors (TFT) of the respective sub pixels which are arranged in the columnar direction are connected to the corresponding video lines (DL) respectively, and each video line (DL) is connected to the drain driver which supplies a video voltage corresponding to display data to the sub pixels arranged in the columnar direction.

Further, the gate electrodes of the thin film transistors (TFT) in the respective sub pixels arranged in the row direction are respectively connected to the corresponding scanning lines (GL), and each scanning line (GL) is connected to the gate driver which supplies a scanning voltage (a positive or negative bias voltage) to the gates of the thin film transistors (TFT) for one horizontal scanning time.

To display an image on the liquid crystal display panel 21, the gate drivers sequentially select the scanning lines (GL) from the top to the bottom, for example. On the other hand, during a period in which a certain scanning line is selected, the drain drivers supply image voltages corresponding to display data to the corresponding video lines (DL).

A voltage supplied to the video line (DL) is applied to the pixel electrode (PX) through the thin film transistor (TFT) and, eventually, a charge is supplied to the holding capacity (Cadd) and the liquid crystal capacity (LC) whereby liquid crystal molecules are controlled thus realizing an image display.

The liquid crystal display panel 21 is constituted as follows. The first substrate on which the pixel electrodes (PX), the thin film transistor (TFT) and the like are formed and the second substrate on which color filters are formed overlap each other with a predetermined gap therebetween. Both substrates are adhered to each other using a frame-shaped sealing material which is sandwiched between both substrates and is arranged in the vicinity of a peripheral portion. Liquid crystal is filled and sealed between both substrates inside the sealing material through a liquid crystal filling port formed in a portion of the sealing material. A polarizer is adhered to outer sides of both substrates respectively.

Here, when the liquid crystal display panel 21 is a TN-type or VA-type liquid crystal display panel, the counter electrode (CT) is mounted on a second substrate side. When the liquid crystal display panel 21 is an IPS-type liquid crystal display panel, the counter electrode (CT) is mounted on a first substrate side.

The present invention is irrelevant to the internal structure of the liquid crystal panel and hence, the detailed explanation of the internal structure of the liquid crystal panel is omitted. Further, the present invention is applicable to a liquid crystal panel having any structure.

[One Example of Protection Circuit of Conventional Power Source Circuit]

Figure 5:
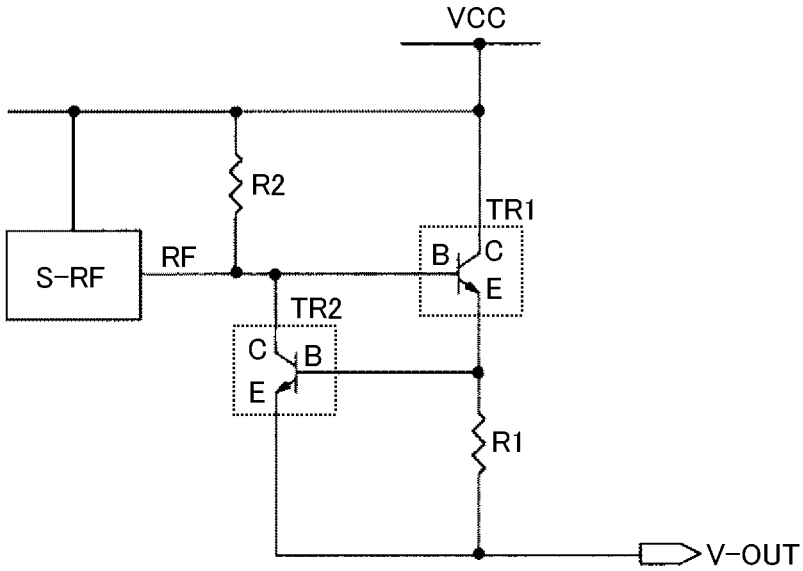
FIG.5 PRIOR ART
FIG. 5 is a circuit diagram showing the circuit constitution of one example of an output circuit and a protection circuit in a conventional power source circuit.

FIG. 5 is a circuit diagram showing the circuit constitution of one example of an output circuit and a protection circuit in a conventional power source circuit. FIG. 5 shows the protection circuit of the above-mentioned example 1.

In FIG. 5, transistors TR1, TR2 are each formed of an npn-type bipolar transistor. The transistor TR1 is an output transistor which constitutes a buffer circuit. The output transistor (TR1) amplifies an electric current of a drive voltage signal (RF) outputted from a drive voltage signal generation circuit (S-RF) and outputs a drive voltage (VOUT) from a collector (C) thereof. That is, the output transistor (TR1) amplifies an electric current of the drive voltage signal (RF) inputted to a base (B) thereof, and outputs as the drive voltage (VOUT) from the collector (C).

Further, the transistor (TR2) and a resistance element (R1) constitute a protection circuit.

In the output circuit shown in FIG. 5, when an overcurrent flows into the output transistor (TR1) (hereinafter, referred to as an overcurrent operation state) due to a reason that a line to which a drive voltage (VOUT) is supplied is short-circuited (so-called short-circuiting) or the like, a voltage drop of the resistance element (R1) becomes large so that the transistor (TR2) is turned on. When the transistor (TR2) is turned on, a base potential of the output transistor (TR1) is lowered so that a collector current of the output transistor (TR1) is decreased.

In this manner, in the protection circuit shown in FIG. 5, when the output transistor (TR1) is brought into an overcurrent operation state, the base current of the output transistor (TR1) is controlled in the decreasing direction so that the collector current of the output transistor (TR1) is limited to a fixed value whereby the output transistor (TR1) is protected from an overcurrent.

In the protection circuit shown in FIG. 5, however, when the output transistor (TR1) is in an overcurrent operation state, the collector current of the output transistor (TR1) continues to flow at a fixed limited value. Accordingly, the generation of heat from the output transistor (TR1) and the resistance element (R1) becomes large whereby it is necessary to adopt parts which have larger allowable power. As a result, sizes of parts and areas for mounting parts become large thus pushing up a cost for parts.

[Another Example of Protection Circuit of Conventional Power Source Circuit]

Figure 6:
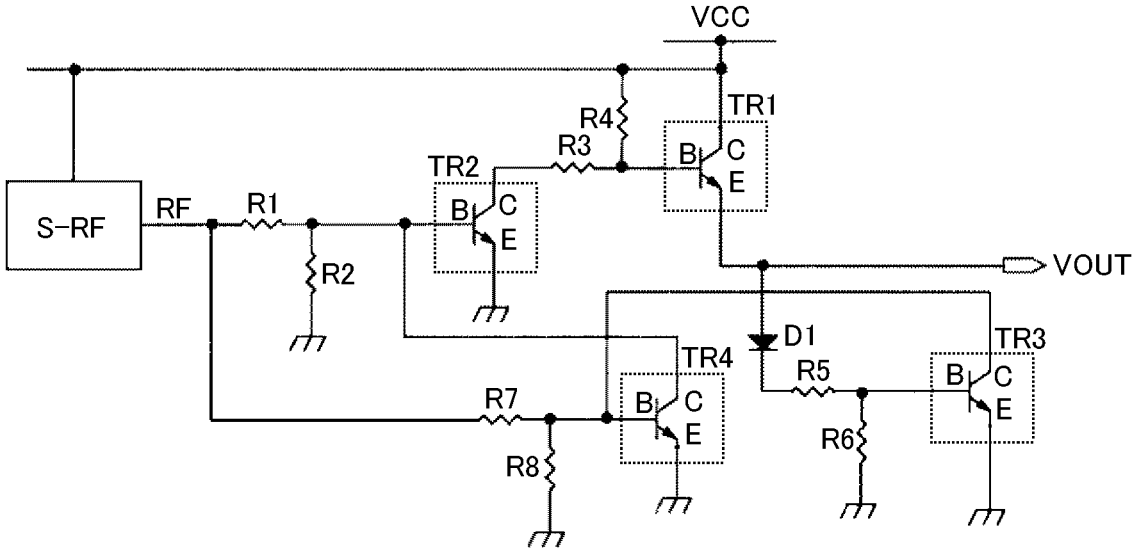
FIG.6 PRIOR ART
FIG. 6 is a circuit diagram showing the circuit constitution of another example of the output circuit and the protection circuit in the conventional power source circuit.

FIG. 6 is a circuit diagram showing the circuit constitution of another example of an output circuit and a protection circuit in a conventional power source circuit. FIG. 6 shows the protection circuit of the above-mentioned example 2.

In FIG. 6, transistors TR1 to TR4 are each formed of an npn-type bipolar transistor. The transistor TR1 is an output transistor which constitutes a buffer circuit, and a drive voltage signal (RF) outputted from a drive voltage signal generation circuit (S-RF) is inputted to the output transistor (TR1) through an output control transistor (TR2).

The output transistor (TR1) amplifies an electric current of a drive voltage signal inputted to a base (B) thereof, and outputs a drive voltage (VOUT) from a collector (C) thereof.

Further, transistors (TR3, TR4), resister elements (R5 to R8) and a diode (D1) constitute a protection circuit. In the output circuit shown in FIG. 6, when an overcurrent flows into the output transistor (TR1) (hereinafter, referred to as an overcurrent operation state) due to a reason that a line through which a drive voltage (VOUT) is supplied is short-circuited (so-called short-circuiting) or the like so that an emitter potential of the output transistor (TR1) is lowered, the transistor (TR3) is turned off due to a voltage value set by the diode (D1) and resistance elements (R5, R6) and hence, a base potential of the transistor (TR4) is elevated whereby the transistor (TR4) is turned on.

When the transistor (TR4) is turned on, the output control transistor (TR2) is turned off, and the output transistor (TR1) is turned off and hence, the output transistor (TR1) is protected from an overcurrent.

In the output circuit shown in FIG. 6, however, the output transistor (TR1) is turned off when the line through which the drive voltage (VOUT) is supplied is short-circuited and, to recover an output when a cause of an overcurrent such as short-circuiting of the line is eliminated after the output transistor (TR1) is turned off, it is necessary to reset a drive voltage signal (RF) outputted from the drive voltage signal generation circuit (S-RF) to a Low level.

In this manner, in the output circuit shown in FIG. 6, also in the case of a temporary overcurrent, the output transistor (TR1) is turned off so that automatic recovery cannot be acquired.

[One Example of Power Source Circuit of the Present Invention]

Figure 2:
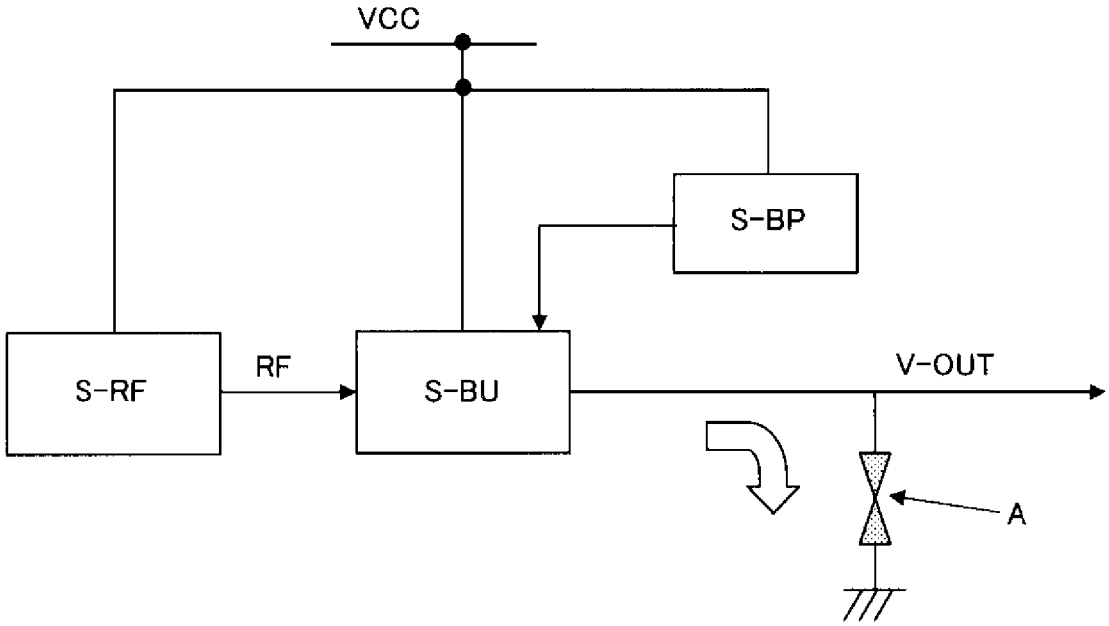
FIG. 2 is a block diagram showing the circuit constitution of a power source circuit shown in FIG. 1.

FIG. 2 is a block diagram showing the circuit constitution of the power source circuit shown in FIG. 1. In FIG. 2, symbol S-BU indicates an output circuit, and symbol S-BP indicates a protection bypass circuit. In this embodiment, when an overcurrent is generated in the output circuit (S-BU), the protection bypass circuit (S-BP) temporarily turns off the output circuit (S-BU) thus protecting the output circuit (S-BU). Then, an OFF state of the output circuit (S-BU) is automatically released. When an overcurrent operation state continues, until abnormality of an overcurrent is eliminated, turning off of the output circuit (S-BU), turning on of the output circuit (S-BU), turning off of the output circuit (S-BU), are repeated. Due to such an operation, the generation of heat from parts due to an overcurrent can be suppressed. Further, when a cause of an overcurrent is eliminated, the output circuit (S-BU) automatically returns to a normal operation.

In this manner, according to this embodiment, while allowing the automatic return from the protection which becomes necessary to cope with an overcurrent, a function of protecting the output circuit (S-BU) can be achieved at a low cost whereby a manufacturing cost of a display device can be lowered.

Figure 3:
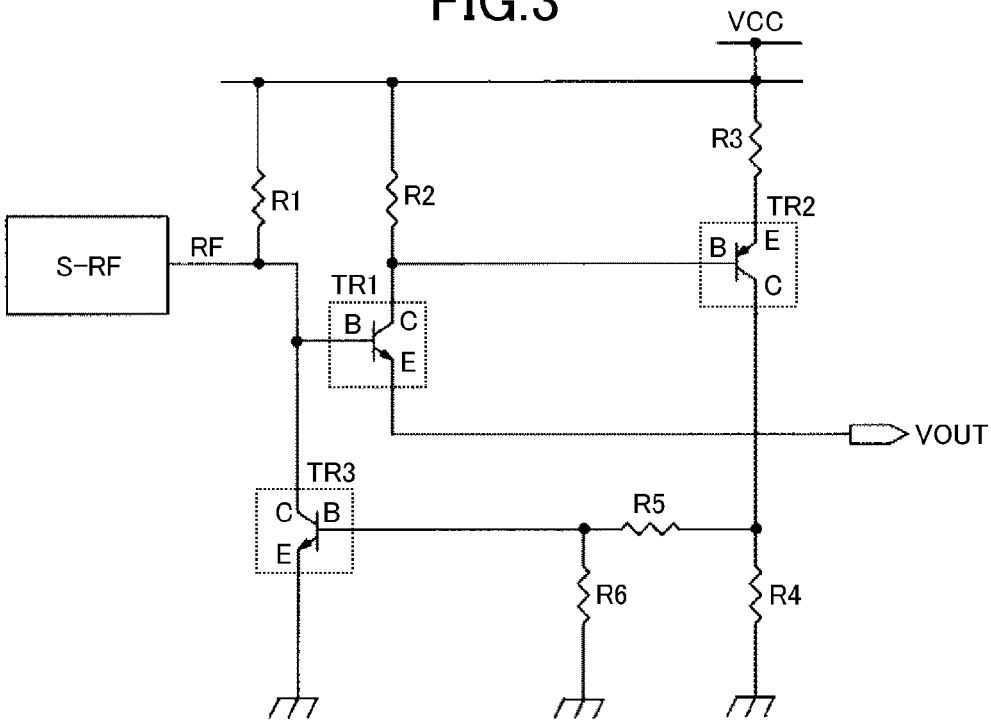
FIG. 3 is a circuit diagram showing the circuit constitution of an output circuit and a protection circuit shown in FIG. 2.

FIG. 3 is a circuit diagram showing the circuit constitution of the output circuit and the protection circuit shown in FIG. 2. In FIG. 3, the transistors TR1, TR3 are each formed of an npn-type bipolar transistor, and a transistor TR2 is formed of a pnp-type bipolar transistor.

The transistor (TR1) is an output transistor constituting a buffer circuit. The output transistor (TR1) amplifies a current of a drive voltage signal (RF) outputted from a drive voltage signal generation circuit (S-RF), and outputs a drive voltage (VOUT) from a collector (C). That is, the output transistor (TR1) amplifies a current of the drive voltage signal (RF) inputted to a base (B), and outputs the drive voltage (VOUT) from the collector (C).

In this embodiment, the drive voltage signal (RF) generated in the drive voltage signal generation circuit (S-RF) means the drive voltage (VOUT) before the current amplification. That is, the drive voltage (VOUT) is the drive voltage which is generated by the drive voltage signal generation circuit (S-RF) and is outputted through the buffer circuit.

Here, the drive voltage inputted to the drain driver is constituted of a gradation reference voltage, a logic-use power source voltage, a high-voltage power source voltage higher than the logic-use power source voltage and the like while the drive voltage inputted to the gate driver is constituted of a gate ON voltage which turns on the thin film transistor (TFT), a gate OFF voltage which turns off the thin film transistor (TFT), a logic-use power source voltage and the like.

Here, the transistors (TR2, TR3) and resistance elements (R4 to R6) constitute the protection circuit.

In the output circuit of this embodiment, for example, as indicated by A in FIG. 2, when an overcurrent flows into the output transistor (TR1) (hereinafter, referred to as an overcurrent operation state) due to the reason that a line through which the drive voltage (VOUT) is supplied is short-circuited (so-called short-circuiting) or the like, a voltage drop of the resistance element (R2) becomes large so that the transistor (TR2) is turned on.

When the transistor (TR2) is turned on, a voltage drop of the resistance element (R4) becomes large so that a base potential of the transistor (TR3) is elevated whereby the transistor (TR3) is turned on. Accordingly, a base potential of the output transistor (TR1) is lowered so that the output transistor (TR1) is turned off.

When the output transistor (TR1) is turned off, a voltage drop of the resistance element (R2) is eliminated and hence, the transistor (TR2) is turned off and the transistor (TR3) is turned off whereby the output transistor (TR1) is turned on leading to the recovery of the output transistor (TR1).

When an overcurrent operation state continues in such a state, the output transistor (TR1) is turned off again due to a voltage drop of the resistance element (R2).

In this manner, in the output circuit shown in FIG. 3, within a period of the overcurrent operation state, the transistor (TR2) and the transistor (TR3) repeat an ON operation and an OFF operation thus intermittently operating the output transistor (TR1), and when an operation state is shifted to a normal operation state from the overcurrent operation state, the transistor (TR2) and the transistor (TR3) are turned off, and the output transistor (TR1) automatically returns to a normal operation.

As has been explained heretofore, according to this embodiment, within the period during which an overcurrent operation state continues, the circuit protection is performed by intermittently operating the output transistor (TR1) thus preventing the generation of heat in circuit parts due to an overcurrent.

Further, when an operation state is shifted to a normal operation state from an overcurrent operation state, the output transistor (TR1) automatically returns to a normal operation. In this manner, this embodiment adopts a protection method where a large current is not generated in parts in an overcurrent operation state and hence, it is unnecessary to increase rated power margins of parts whereby a cost for parts can be reduced.

Figure 4:
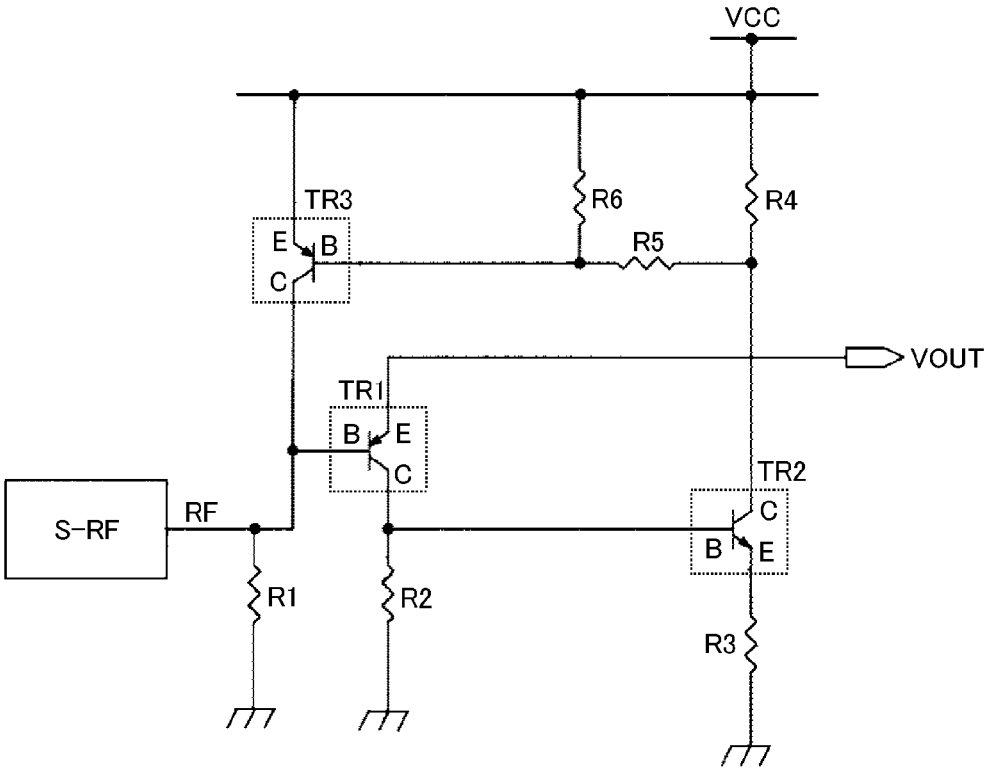
FIG. 4 is a circuit diagram showing a modification of the circuit constitution of an output circuit and a protection circuit shown in FIG. 2.

As shown in FIG. 4, the output transistor (TR1) and the transistor (TR3) each may be formed of a pnp-type bipolar transistor in place of the npn-type bipolar transistor, and the transistor (TR3) may be formed of an npn-type bipolar transistor in place of the pnp-type bipolar transistor.

Further, the transistors TR1 to TR4 each may be formed of a unipolar transistor such as a field effect transistor in place of the bipolar transistor.

In the above-mentioned embodiment, the present invention has been explained with respect to the embodiment where the present invention is applied to the liquid crystal display device. However, it is needless to say that the present invention is not limited to the embodiment and, for example, the present invention is also applicable to other display devices such as an organic EL display device.

Although the invention made by the inventors has been specifically explained in conjunction with the embodiment, it is needless to say that the present invention is not limited to the embodiment, and various modifications are conceivable without departing from the gist of the present invention.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A display device comprising:

a display panel having a drive circuit; and a power source circuit which supplies a drive voltage to the drive circuit, the power source circuit comprising: a drive voltage signal generation circuit which generates a drive voltage signal; an output transistor which has a control electrode to which the drive voltage signal generated by the drive voltage signal generation circuit is inputted, the output transistor outputting the drive voltage from a first electrode; a first transistor which is turned on when an overcurrent flows into the output transistor; and a second transistor which is turned on and turns off the output transistor when the first transistor is turned on, wherein assuming a period during which the overcurrent continuously flows into the output transistor as an overcurrent operation period and a period during which the output transistor is normally operated as a normal operation period, the first transistor and the second transistor are repeatedly turned on and off so as to make the output transistor intermittently operate within the overcurrent operation period, and the first transistor and the second transistor are turned off and the output transistor automatically returns to a normal operation when an operation period is shifted from the overcurrent operation period to the normal operation period which is the period during which the output transistor is normally operated.

2. The display device according to claim 1, wherein the display device is a liquid crystal display device, and the display panel is a liquid crystal display panel.

3. A display device comprising:

a display panel having a drive circuit; and a power source circuit which supplies a drive voltage to the drive circuit, the power source circuit comprising: a drive voltage signal generation circuit which generates a drive voltage signal; an output transistor which has a control electrode to which the drive voltage signal generated by the drive voltage signal generation circuit is inputted, the output transistor outputting the drive voltage from a first electrode; a first resistance element which is connected between a second electrode of the output transistor and a first power source line to which a first power source voltage is supplied; a first transistor which has a first electrode thereof electrically connected to the first power source line and a control electrode thereof connected to the second electrode of the output transistor; a second resistance element which is connected between a second electrode of the first transistor and a second power source line to which a second power source voltage is supplied; and a second transistor which has a first electrode thereof connected to the second power source line, a second electrode thereof connected to the control electrode of the output transistor, and a control electrode thereof electrically connected to the second electrode of the first transistor, wherein assuming a period during which the overcurrent continuously flows into the output transistor as an overcurrent operation period and a period during which the output transistor is normally operated as a normal operation period, the first transistor and the second transistor are repeatedly turned on and off so as to make the output transistor intermittently operate within the overcurrent operation period, and the first transistor and the second transistor are turned off and the output transistor automatically returns to a normal operation when an operation period is shifted from the overcurrent operation period to the normal operation period.

4. The display device according to claim 3, wherein the power source circuit further comprises:

a third resistance element being connected between the control electrode of the second transistor and a connection point between the second resistance element and the second electrode of the first transistor; and a fourth resistance element being connected between the second power source line and a connection point between the third resistance element and the control electrode of the second transistor.

5. The display device according to claim 3, wherein the output transistor, the first transistor and the second transistor are each formed of a bipolar transistor.

6. The display device according to claim 5, wherein the output transistor and the second transistor are each formed of an npn-type bipolar transistor, and the first transistor is formed of a pnp-type bipolar transistor.

7. The display device according to claim 5, wherein the output transistor and the second transistor are each formed of an pnp-type bipolar transistor, and the first transistor is formed of a npn-type bipolar transistor.

8. The display device according to claim 3, wherein the display device is a liquid crystal display device, and the display panel is a liquid crystal display panel.

* * * * *